US008500455B2

(12) United States Patent
Jin

(10) Patent No.: US 8,500,455 B2
(45) Date of Patent: Aug. 6, 2013

(54) MAGNETIC CONNECTOR HAVING IMPROVED GROUNDING MEMBER

(75) Inventor: Hao Jin, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 85 days.

(21) Appl. No.: 13/290,140

(22) Filed: Nov. 7, 2011

(65) Prior Publication Data

US 2012/0115337 A1 May 10, 2012

(51) Int. Cl.
*H01R 12/00* (2006.01)

(52) U.S. Cl.
USPC ..... 439/63

(58) Field of Classification Search
USPC ..... 439/38, 39, 63, 581
See application file for complete search history.

(56) References Cited

U.S. PATENT DOCUMENTS

| | | | | |
|---|---|---|---|---|
| 7,510,437 | B2 * | 3/2009 | Wu | 439/581 |
| 7,621,753 | B1 | 11/2009 | Pai | |
| 7,789,667 | B2 * | 9/2010 | Zhu et al. | 439/39 |
| 7,901,249 | B1 * | 3/2011 | Chen | 439/607.4 |
| 8,337,254 | B2 * | 12/2012 | Jin | 439/675 |

* cited by examiner

*Primary Examiner* — Tho D Ta
*Assistant Examiner* — Larisa Tsukerman
(74) *Attorney, Agent, or Firm* — Wei Te Chung; Ming Chieh Chang

(57) ABSTRACT

A magnetic connector includes an insulative housing having a chamber, a first contact retained in the chamber, a magnetic element having a receiving hole recessed rearwards from a front face thereof for accommodating the housing therein, and a grounding member exposed outside of the magnetic element to surrounding the magnetic element. The grounding member covers the front face of the magnetic element for mating with a counterpart contact. The grounding member exposed outside of the magnetic element and covers the front face for facilitating reliable interconnection with a counterpart contact.

14 Claims, 5 Drawing Sheets

MAGNETIC CONNECTOR HAVING IMPROVED GROUNDING MEMBER

BACKGROUND OF THE INVENTION

1. Field of the Invention

The present invention relates generally to a magnetic connector, and more particularly to a magnetic connector having improved grounding member exposed outside of a magnetic element for facilitating reliable interconnection with a counterpart contact.

2. Description of the Related Art

U.S. Pat. No. 7,621,753 issued to Pai on Nov. 24, 2009 discloses a magnetic power socket including an insulative housing having a hollow chamber, a positive contact received in the hollow chamber, a grounding copper ring enclosing the housing and the positive contact, and a magnetic member for receiving the housing. The magnetic member defines a hole recessed from a front face and providing a mating opening at the front face thereof, the housing assembled with the positive contact and the grounding copper ring is received in the hole from the opening, and the grounding copper ring provides a mating face disposed in the hole and facing to the opening for mating with a mating contact. However, the ringed mating face received inside of the magnetic member and sandwiched between the housing and the magnetic member provides little mating surface in the hole, and it is hard to get a reliable connection between the grounding copper ring and the mating contact.

Hence, a magnetic connector having improved grounding member is desired to overcome the aforementioned disadvantage of the prior art.

SUMMARY OF THE INVENTION

Accordingly, an object of the present invention is to provide a magnetic connector having improved grounding member which provides large mating face to get a reliability connection.

In order to achieve the object set forth, a magnetic connector includes an insulative housing having a chamber, a first contact retained in the chamber, a magnetic element having a receiving hole recessed rearwards from a front face thereof for accommodating the housing therein, and a grounding member exposed outside of the magnetic element to surrounding the magnetic element. The grounding member covers the front face of the magnetic element for mating with a counterpart contact.

Other objects, advantages and novel features of the invention will become more apparent from the following detailed description of the present embodiment when taken in conjunction with the accompanying drawings.

DETAILED DESCRIPTION OF THE INVENTION

Figure 1:
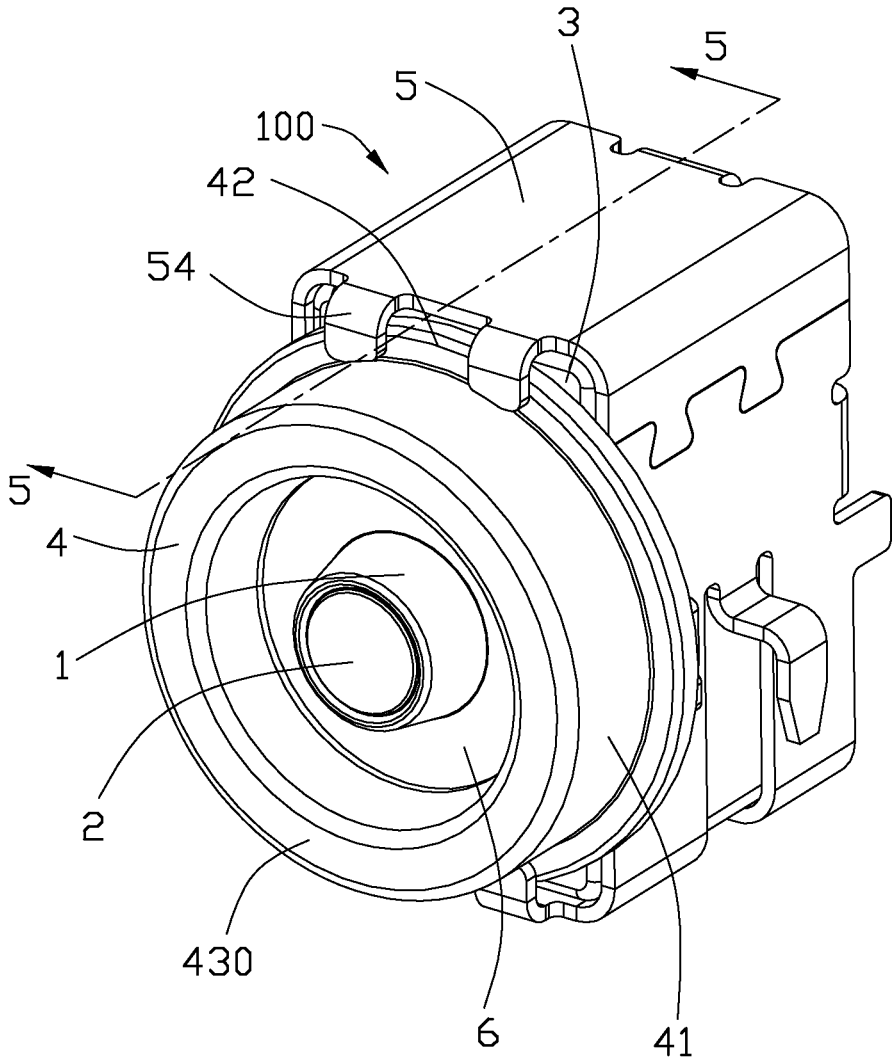
FIG. 1 is an assembled, perspective view of a magnetic connector in accordance with the present invention.

Reference will now be made to the drawing figures to describe a preferred embodiment of the present invention in detail.

Figure 2:
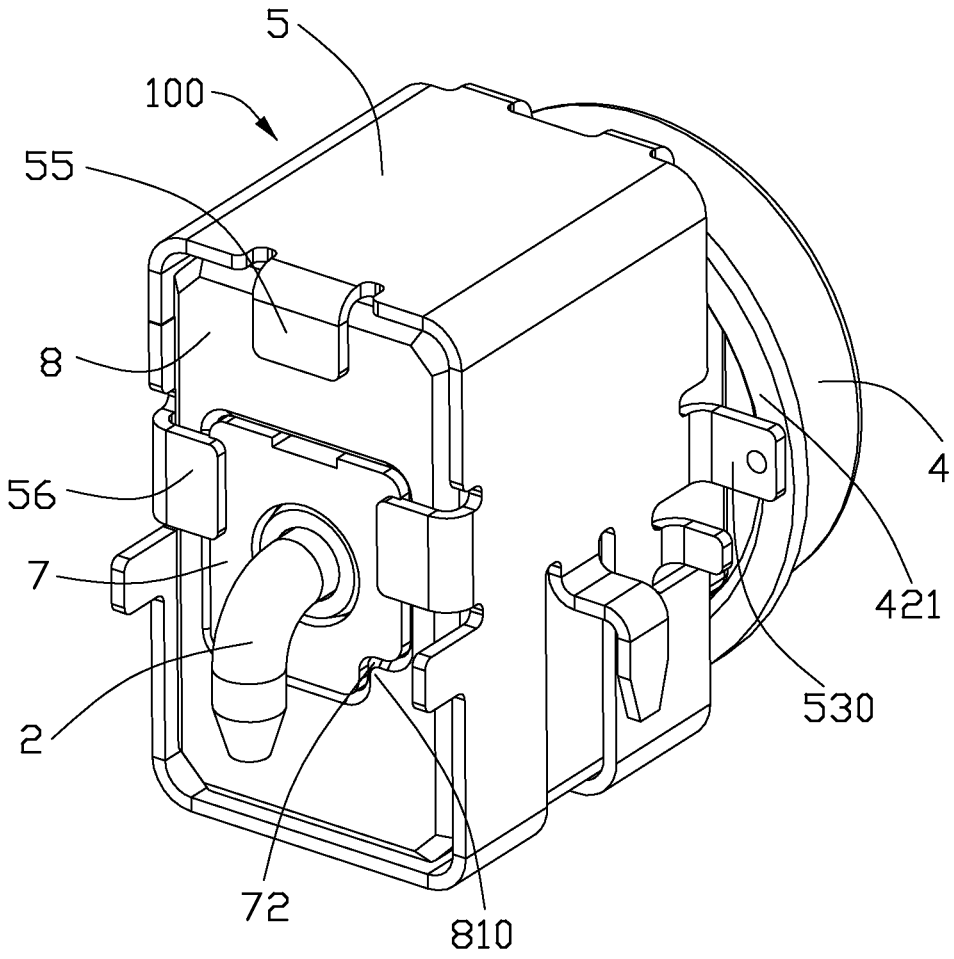
FIG. 2 is another perspective view of the magnetic connector shown in FIG. 1.
Figure 3:
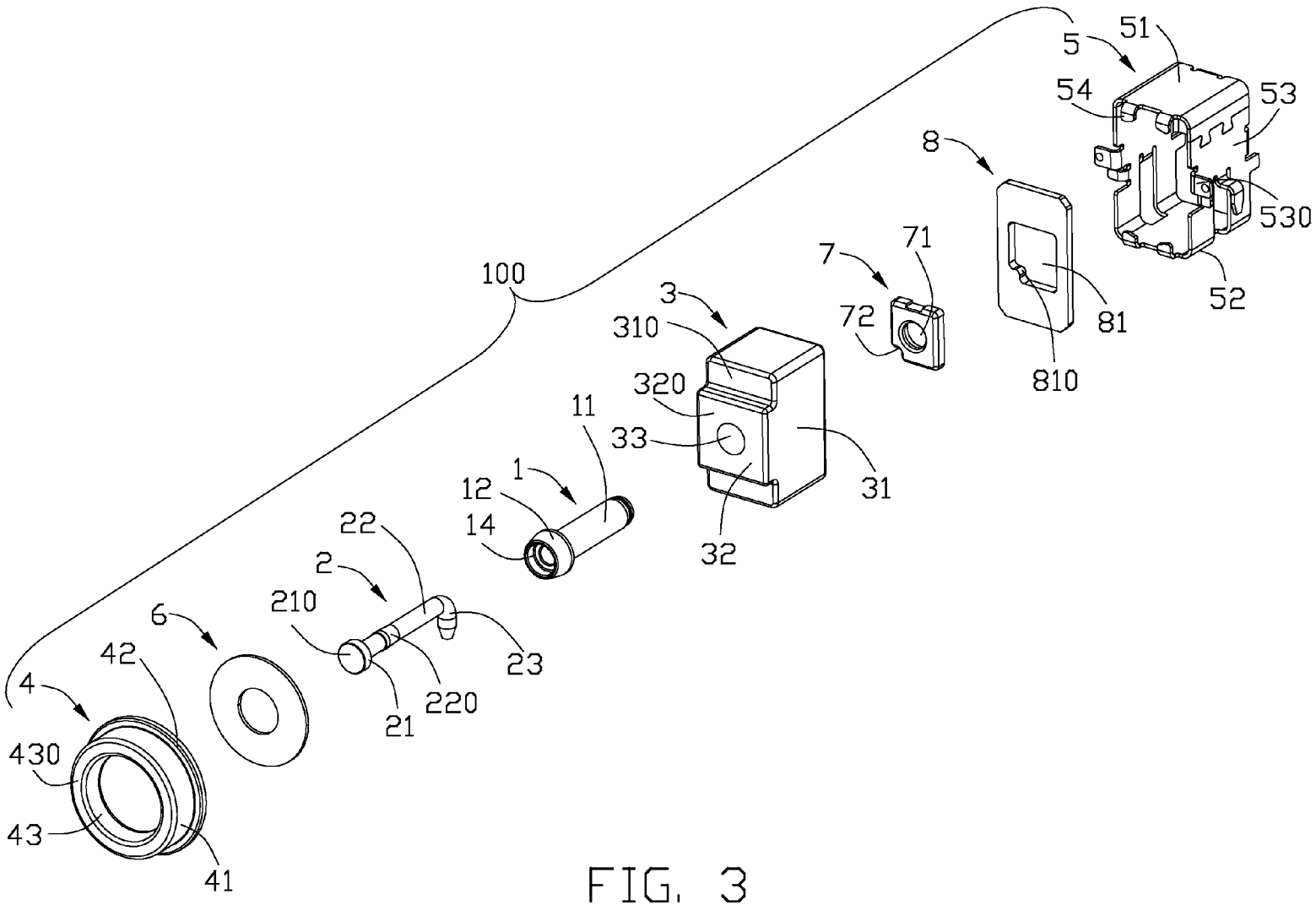
FIG. 3 is an exploded view of the magnetic connector shown in FIG. 1.

Referring to FIGS. 1, 2 and 3, disclosed here is an magnetic connector 100 made in accordance with the present invention. The magnetic connector 100 mainly includes an insulative housing 1, a first contact 2 received in the housing 1, a magnetic element 3 receiving the housing 1 and the first contact 2 therein, and a grounding member enclosing the magnetic element 3.

Figure 4:
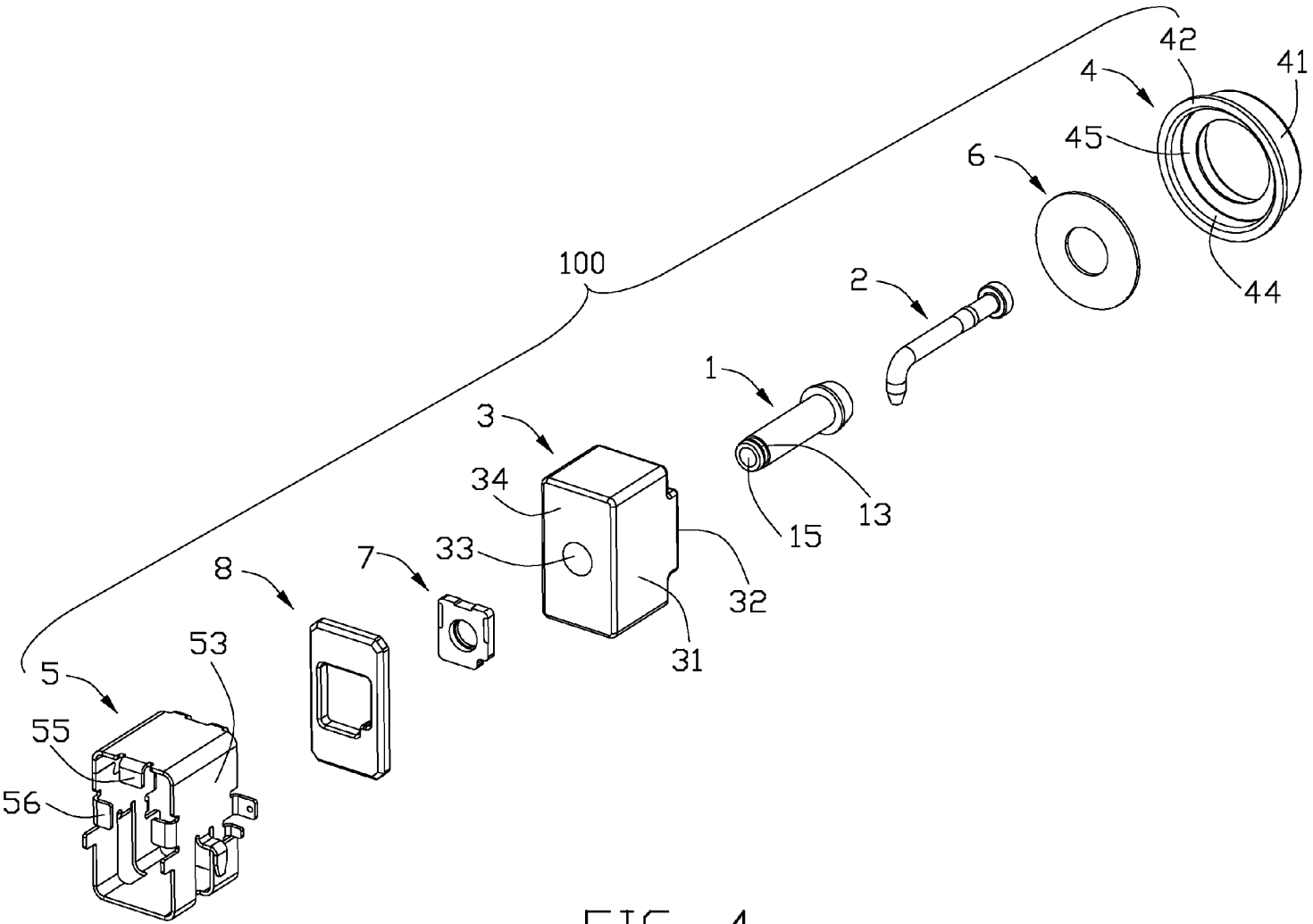
FIG. 4 is another exploded view of the magnetic connector shown in FIG. 3.
Figure 5:
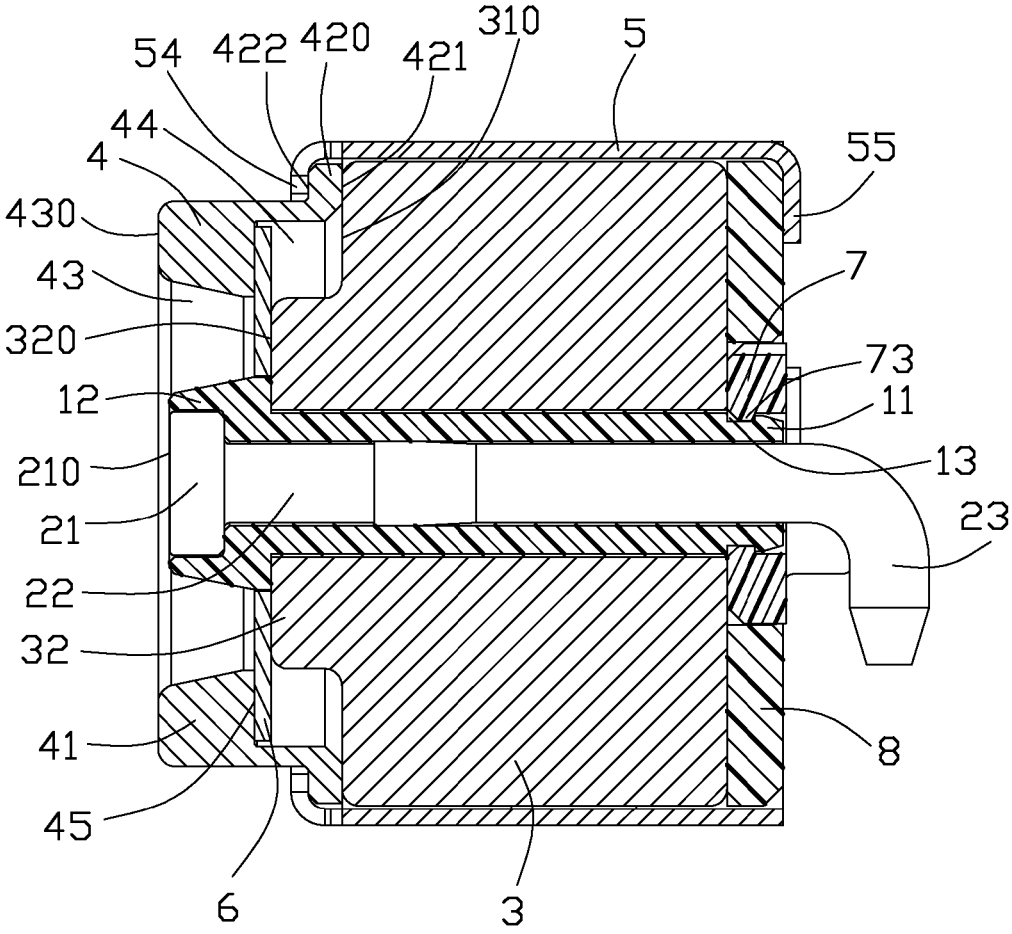
FIG. 5 is a cross-section view of the magnetic connector taken along line 5-5 of FIG. 1.

Referring to FIGS. 3, 4 and 5, the insulative housing 1 defines a columnar main body portion 11 and an enlarged head portion 12 provided at a front end of the main body portion 11. The main body portion 11 defines a columnar slot 13 recessed from a peripheral surface at a rear end thereof. The housing 1 defines a chamber running through the head portion 12 and the main body portion 11, and the chamber provides a first receiving room 14 opening forwardly at a middle portion of the head portion 12 and a second receiving room 15 provided in the main body portion 11 to communicate with the first receiving room 14. The first contact 2 defines a retaining portion 22, an enlarged contacting portion 21 extending forwards from the retaining portion 22, and a soldering portion 23 bending from a rear end of the retaining portion 22. The first contact 2 is assembled to the housing 1 to act as a positive contact of the magnetic connector 100. The contacting portion 21 is received in the first receiving room 14 and provides a contacting face 210 facing forwardly, the retaining portion 22 is retained in the second receiving room 15, and the soldering portion 23 extends out of the housing 1. The retaining portion 22 provides an engaging portion 220 at a front portion thereof to engage with the main body portion 11 for retaining the first contact 2 in the housing 1 securely.

The magnetic element 3 defines a rectangular base portion 31 and a protrusion 32 projecting forwardly from the base portion 31 at a middle portion thereof, the protrusion 32 provides a front face 320 facing forwardly, the base portion 31 provides two supporting faces 310 respectively disposed at upper and lower sides of the front face 320, and a rear face 34 opposite to the front face 320 and the supporting faces 310. The magnetic element 3 defines a receiving hole 33 recessed from the front face 320 at a middle portion thereof to run through the rear face 34 for accommodating the main body portion 11. The housing 1 assembled with the first contact 2 is inserted into the receiving hole 33 from the front face 320 thereof, the main body portion 11 is received in the receiving hole 33, and the head portion 12 is disposed in front of the receiving hole 33 and abuts against the front face 320 to prevent the housing 1 from moving rearwards overly. The rear end of the main body portion 11 runs through the receiving hole 33 to dispose the slot 13 extending beyond the rear face 34. An insulative locking member 7 is forwardly assembled to the main body portion 11 to receive the rear end in a locking hole 71 disposed at a middle portion of the locking member 7, a locking portion 73 projecting in the locking hole 71 extends into the slot 13 to lock with the housing 1 for preventing the housing 1 from moving forwards overly. The contacting face 210 is disposed in front of the front face 320 and parallel to the front face 320. A circular gasket 6 attaches to the front face 320 and outwardly extends beyond the front face 320, and the head portion 12 forwardly projects through a through hole defined at a middle portion of the gasket 6 to dispose the contacting face 210 extending beyond the gasket 6. A metal frame 8 defining a receiving cavity 81 for accommodating the locking member 7 therein is attached to the rear face 34, and a blocking portion 810 extending from a corner of the receiving cavity 81 projects into a corresponding receiving portion 72 to retain the metal frame 8 and the locking member 7 accurately.

Referring to FIGS. 3, 4 and 5, the grounding member includes a second contact 4 and a metal shell 5 connecting with the second contact 4. The second contact 4 is assembled to the housing 1 to act as a grounding contact of the magnetic connector 100. The second contact 4 defines a ringed mating portion 41 and a supporting portion 42 extending rearwards from the mating portion 41. The mating portion 41 defines a mating face 430 facing forwardly, an abutting face 45 opposite to the mating face 430 and a first receiving space 43 disposed between the mating face 430 and the abutting face 45. The supporting portion 42 extends rearwards from the abutting face 45 and provides a locking portion 420 bending outwards to provide a second receiving space 44 disposed behind the first receiving space 43, the first receiving space 43 runs through the mating face 430 and the abutting face 45 at a middle portion thereof and further communicates with the second receiving space 44. The circular second receiving space 44 has larger diameter than that of the first receiving space 43, and the abutting face 45 is disposed in the second receiving space 43 as a blocking face at a joint of the first receiving space 43 and the second receiving space 44. The metal shell 5 defines a top piece 51, a bottom piece 52 opposite to the top piece 51 and two side pieces 53 connecting with the top piece 51 and the bottom piece 52 respectively. The top piece 51 defines a pair of front locking pieces 54 bending downwardly from a front end thereof and a rear locking piece 55 bending downwardly from a rear end opposite to the front end. The bottom piece 52 defines a pair of front locking pieces 54 bending upwards. The side wall 53 each defines a supporting piece 530 bending outwardly at a front end thereof and a side locking piece 56 bending inwardly from a rear end.

Referring to FIG. 1 to FIG. 5, the second contact 4 is assembled to expose outside of the magnetic element 3 to cover the front face 320 for mating with a mating contact, and the metal shell 5 encloses four side faces of the base portion 31 of the magnetic element 3. The abutting face 45 abuts against the gasket 6, and a first face 421 of the locking portion 420 attaches to the supporting faces 310 at upper and lower portions thereof and abuts against the supporting pieces 530 at two side portions thereof to prevent the second contact 4 from moving rearwards overly. The front locking pieces 54 are bent to lock with the second face 422 of the locking portion 420 to prevent the second contact 4 from moving forwards. The rear locking piece 55 and the side locking pieces 56 are bent to lock with the metal frame 8 to retain the locking member 7 and the metal frame 8 to the magnetic element 3. The head portion 12 retaining the contacting portion 21 therein is disposed in the first receiving cavity 43, and the protrusion 32 is disposed in the second receiving cavity 44. The second contact 4 provides a large mating face 430 exposed outside of the magnetic element 3 to cover the front face 320, which makes the second contact 4 can be mated easily and securely.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic connector comprising:

an insulative housing having a chamber;

a first contact retained in the chamber;

a magnetic element having a receiving hole recessed rearwards from a front face thereof for accommodating the housing therein; and a grounding member exposed outside of the magnetic element to surrounding the magnetic element;

wherein the grounding member covers the front face of the magnetic element for mating with a counterpart contact wherein the grounding member defines a metal shell surrounding the magnetic element and the second contact connecting with the metal shell, and the second contact covers the front face and provides a mating face facing forwardly and disposed in front of the front face; and wherein the second contact defines a first receiving space recessed toward the front face of the magnetic element from the mating face at a middle portion thereof, and the first contact defines a contacting portion projecting beyond the front face to enter into the first receiving space.

2. The magnetic connector as described in claim 1, wherein the second contact defines a supporting portion extending rearwards from the mating face thereof, the supporting portion provides a locking portion bending outwards and a second receiving space disposed behind the first receiving space.

3. The magnetic connector as described in claim 1, wherein the housing defines a main body portion retained in the receiving hole and an enlarged head portion extending beyond the front face and disposed in the first receiving space, the chamber runs through the head portion to provide a first receiving room opening forwardly, and the contacting portion is retained in the first receiving room.

4. The magnetic connector as described in claim 2, wherein the magnetic element defines a base portion and a protrusion forwardly extending from the base portion, the locking portion abuts against the base portion and the protrusion is received in the second receiving space.

5. The magnetic connector as described in claim 4, wherein the metal shell defines a front locking piece bending from a top piece and a supporting piece bending outwardly from a side piece to contact with the locking portion and sandwich the locking portion between the front locking piece and the supporting piece.

6. The magnetic connector as described in claim 5, further defining a gasket attaching to the front face and disposed between the front face and the mating face.

7. The magnetic connector as described in claim 6, wherein the main body portion defines a rear end having a slot recessed from a peripheral surface thereof and extending out of the receiving hole, and a locking member locks with the slot to restrict the housing in a front-to-rear direction.

8. The magnetic connector as described in claim 1, wherein the first contact acts as a positive contact, and the second contact acts as a grounding contact.

9. A magnetic connector comprising:

an insulative housing;

a positive contact retained in the housing;

a magnetic element having a receiving hole recessed rearwards from a front face thereof for accommodating the housing therein;

a metal shell peripherally surrounding the magnetic element; and a grounding contact connecting with the metal shell and covering the front face of the magnetic element;

wherein the grounding contact defines a mating face facing forwardly and a first receiving space recessed toward the front face from the mating face, and the positive contact defines a contacting face disposed in the first receiving space and facing forwardly wherein the housing defines a main body portion retained in the receiving hole and an enlarged head portion extending beyond the front face and disposed in the first receiving space, a contacting portion of the positive contact is retained in the head portion and provides the contacting face.

10. The magnetic connector as described in claim 9, wherein the grounding contact defines a supporting portion extending rearwards from the mating face thereof, the supporting portion provides a locking portion bending outwards and a second receiving space disposed behind the first receiving space.

11. The magnetic connector as described in claim 10, wherein the magnetic element defines a base portion and a protrusion forwardly extending from the base portion, the locking portion abuts against the base portion and the protrusion is received in the second receiving space.

12. The magnetic connector as described in claim 11, wherein the metal shell defines a front locking piece bending from a top piece and a supporting piece bending outwardly from a side piece to contact with the locking portion and sandwich the locking portion therebetween.

13. A magnetic connector comprising:

a tubular insulative housing;

an inner contact disposed in the housing;

a one piece sleeve type magnetic element assembled, along an axial direction, to the housing in a circumferential intimate manner;

a rectangular metallic shell enclosing the magnetic element; and a cylindrical outer grounding contact electrically assembled in front of the shell and being coaxial with the inner contact wherein the housing defines a head portion extending forwardly beyond the magnetic element and radially exposed to the grounding contact; wherein said head portion defines a stopper structure to prevent the magnetic element from moving forward relative to the housing; and wherein a diameter of the grounding contact is larger than a transverse dimension of the shell.

14. The magnetic connector as claimed in claim 13, further including a ring like metallic gasket inside of the grounding contact to cover a front face of the magnetic element.

* * * * *